US006979214B1

(12) United States Patent
Liou

(10) Patent No.: US 6,979,214 B1
(45) Date of Patent: Dec. 27, 2005

(54) CONNECTING DEVICE WITH ADJUSTABLE ROTARY STRUCTURE

(76) Inventor: Chii-Moon Liou, 235 P.O. Box 10-69, Chung-Ho Taipei (TW)

( * ) Notice: Subject to any disclaimer, the term of this patent is extended or adjusted under 35 U.S.C. 154(b) by 0 days.

(21) Appl. No.: 11/010,718

(22) Filed: Dec. 14, 2004

(51) Int. Cl.[7] ..... H01R 3/00
(52) U.S. Cl. ..... 439/165; 439/13
(58) Field of Search ..... 439/13, 165

(56) References Cited

U.S. PATENT DOCUMENTS 6,650,547 B2 * 11/2003 Hemmi et al. ..... 361/755
6,808,402 B2 * 10/2004 Ryu et al. ..... 439/165
6,878,068 B2 * 4/2005 Bigelow et al. ..... 464/126

* cited by examiner

*Primary Examiner*—Truc Nguyen

(57) ABSTRACT

A connecting device with an adjustable rotary structure comprises a cruciform connector; an upper side of the cruciform connector having a slot; a rotary joint having a cruciform hollow space which is capable of receiving the cruciform connector; a center of the rotary joint being extended with a hollow post; an actuating shaft being installed in the receiving chamber; one distal end of the actuating shaft opposite to the head end having at least one pin which is a compressible conductive metal; a spring enclosing a middle section of the actuating shaft; an interface seat having a first ring and a second ring; the cruciform connector being buckled to the second ring; the cruciform connector being movable in the slot; the rotary joint being buckled between the first ring and the second ring; and the cruciform connector passing through the second ring to be embedded into the cruciform hollow space.

5 Claims, 9 Drawing Sheets

CONNECTING DEVICE WITH ADJUSTABLE ROTARY STRUCTURE

FIELD OF THE INVENTION

The present invention relates to connecting devices, and in particular a connecting device with an adjustable rotary structure, which is suitable for compact flash (CF) cards, secure digital (SD) cards, Micro drive (MD) cards, smart media (SM) cards, memory stick (MS) cards, multi-media cards (MMC), extreme digital (XD) cards, and RS 232 interface seats.

BACKGROUND OF THE INVENTION

To have a preferred quality of the receiving signals, the orientations of a satellite receiver must be adjustable. However in the prior art, the orientation is not flexible in adjustment of the orientation. Further, the structure of the receiver is too loose to well fix all the component. This will affect the quality of the receiving signals and the lifetime of the device.

SUMMARY OF THE INVENTION

Accordingly, the primary object of the present invention is to provide a connecting device with an adjustable rotary structure, wherein is suitable for compact flash (CF) cards, secure digital (SD) cards, Micro drive (MD) cards, smart media (SM) cards, memory stick (MS) cards, multi-media cards (MMC), extreme digital (XD) cards, and RS 232 interface seats.

To achieve above objects, the present invention provides a connecting device with an adjustable rotary structure which comprises a cruciform connector; an upper side of the cruciform connector having a slot; a rotary joint having a cruciform hollow space which is capable of receiving the cruciform connector; a center of the rotary joint being extended with a hollow post; an actuating shaft being installed in the receiving chamber; one distal end of the actuating shaft opposite to the head end having at least one pin which is an compressible conductive metal; a spring enclosing a middle section of the actuating shaft; an interface seat having a first ring and a second ring; the cruciform connector being buckled to the second ring; the cruciform connector is movable in the slot; the rotary joint being buckled between the first ring and the second ring; and the cruciform connector passing through the second ring to be embedded into the cruciform hollow space.

The various objects and advantages of the present invention will be more readily understood from the following detailed description when read in conjunction with the appended drawing.

DETAILED DESCRIPTION OF THE INVENTION

Figure 1:
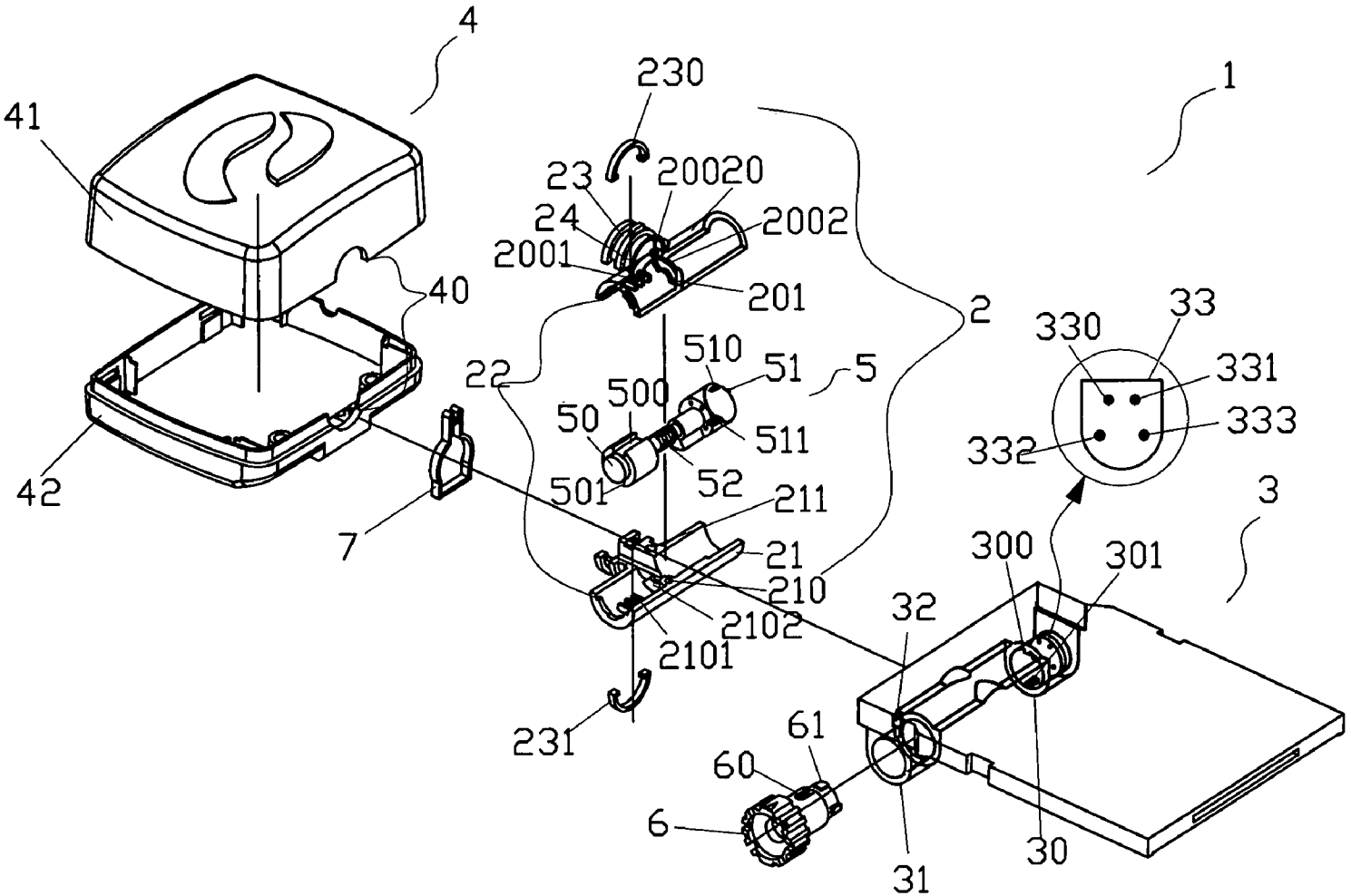
FIG. 1 is an exploded perspective view of the present invention.
Figure 2:
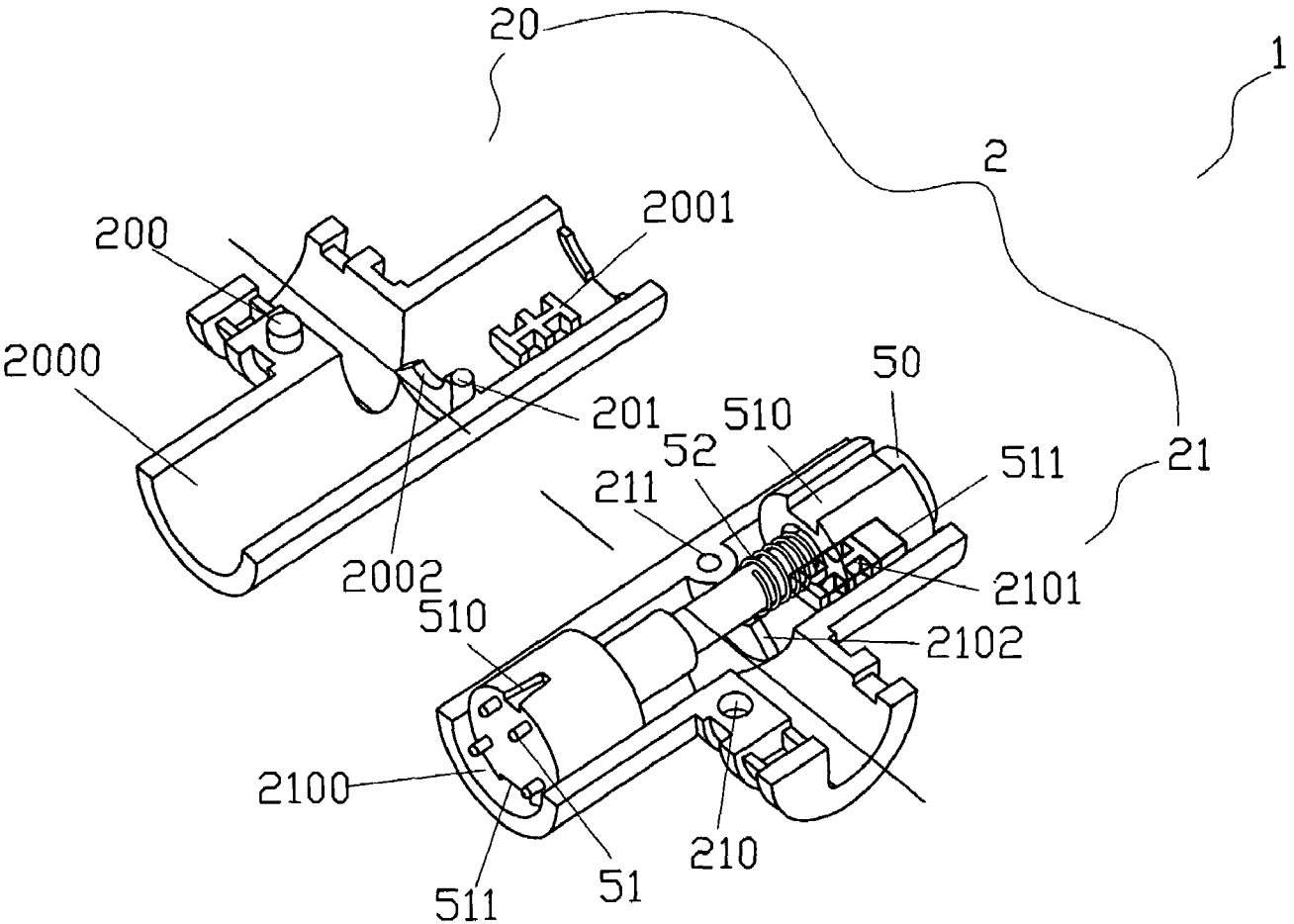
FIG. 2 shows the internal structure of the rotary joint of the present invention.
Figure 3:
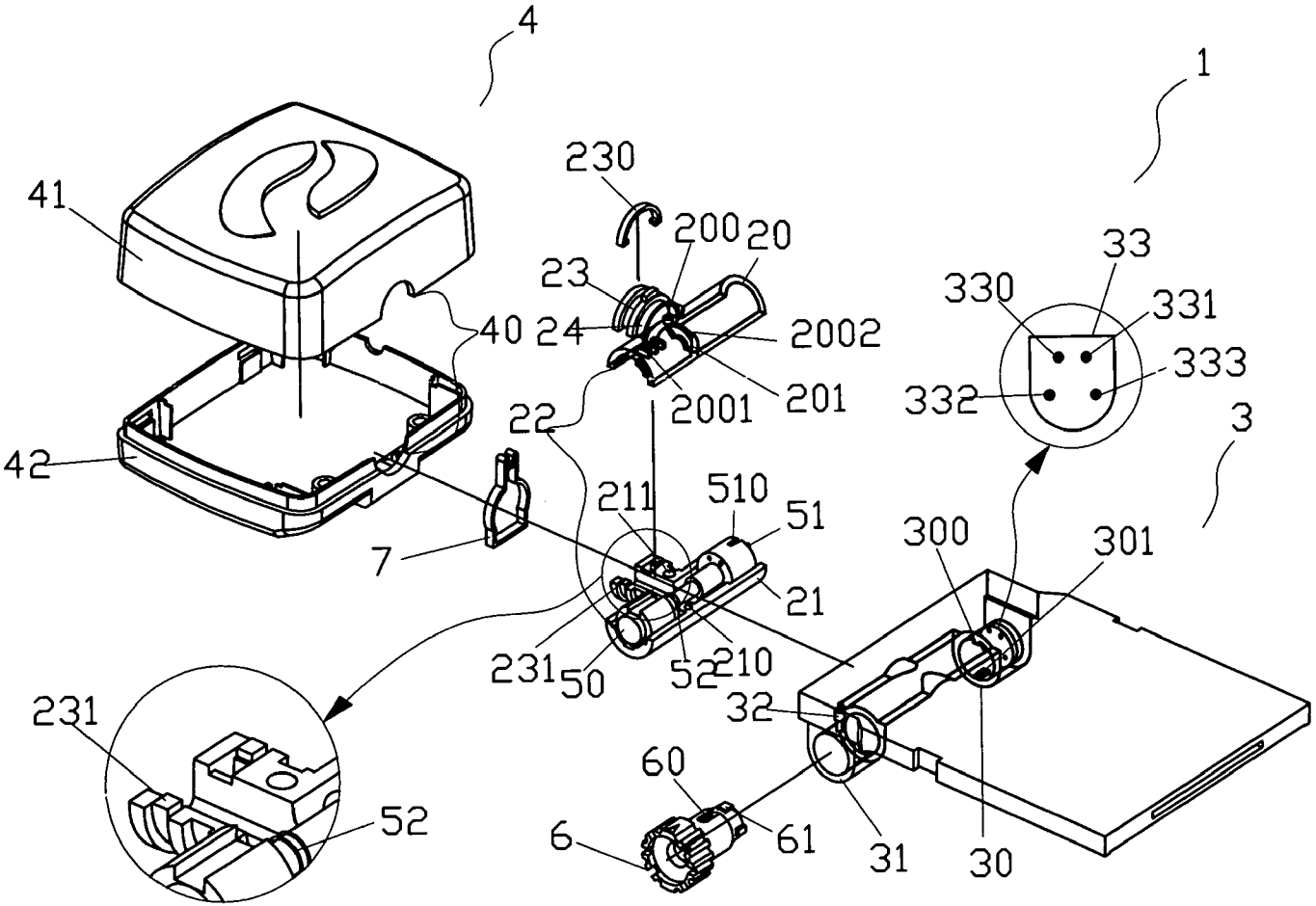
FIG. 3 is the rotary joint of the present invention before assembly.
Figure 4:
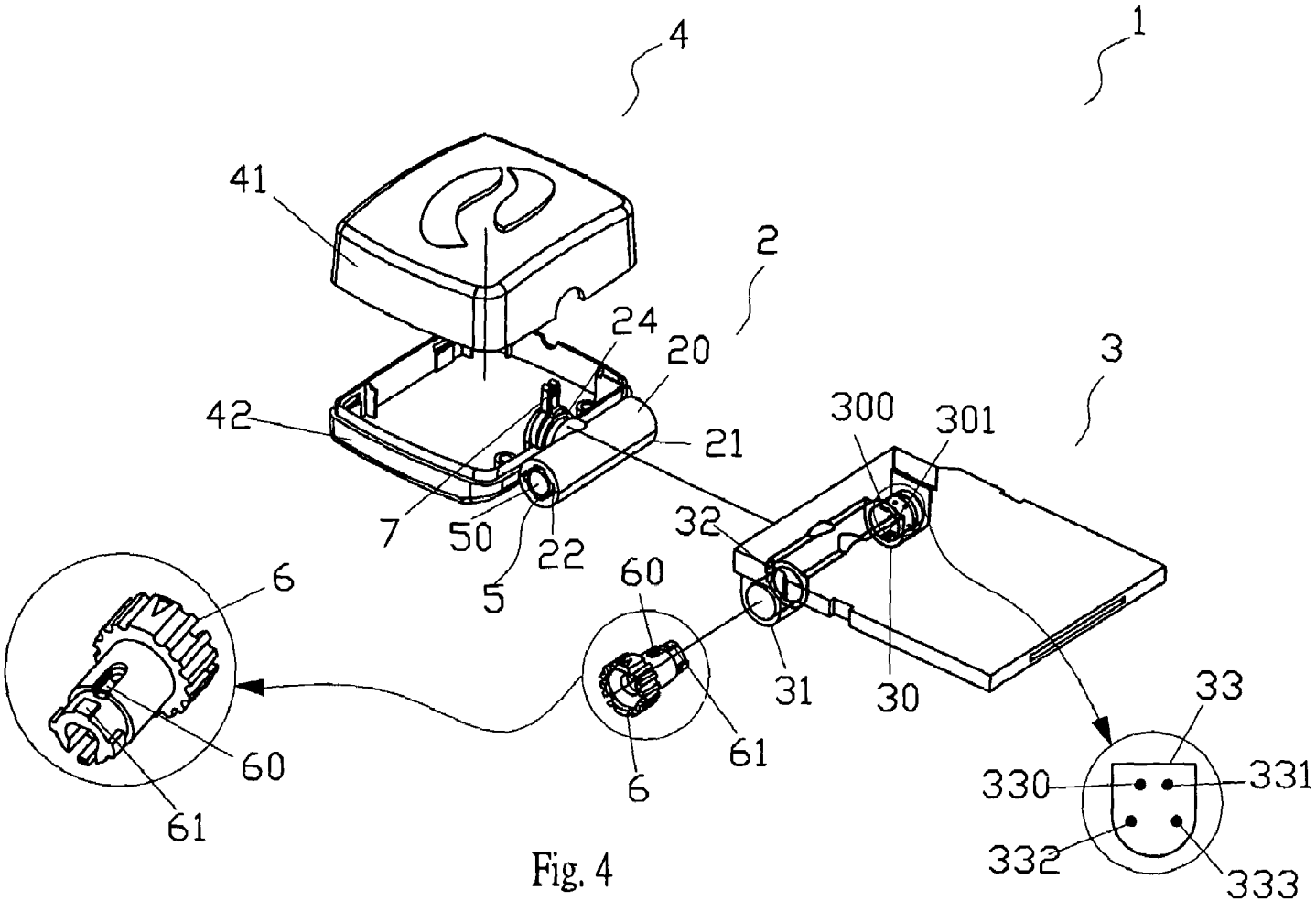
FIG. 4 is the rotary joint of the present invention after assembly.
Figure 5:
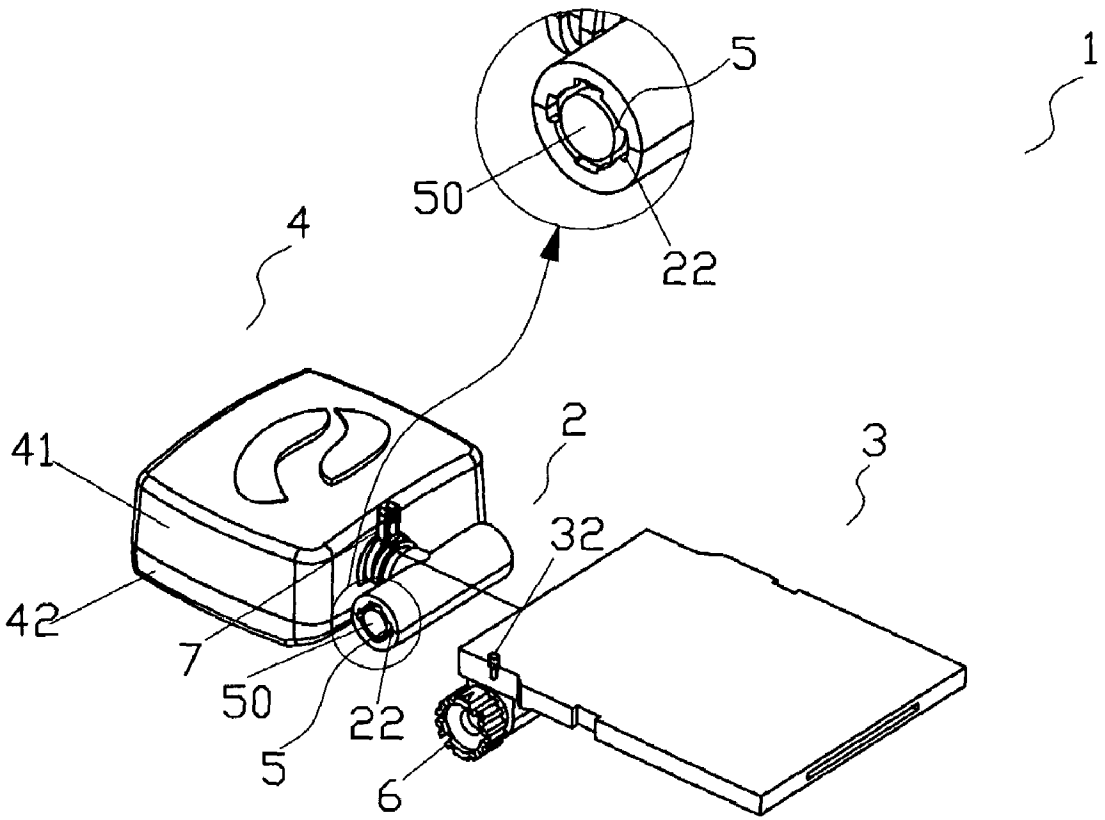
FIG. 5 shows one application of the present invention, where the present invention is desired to be connected to a satellite receiver.
Figure 6:
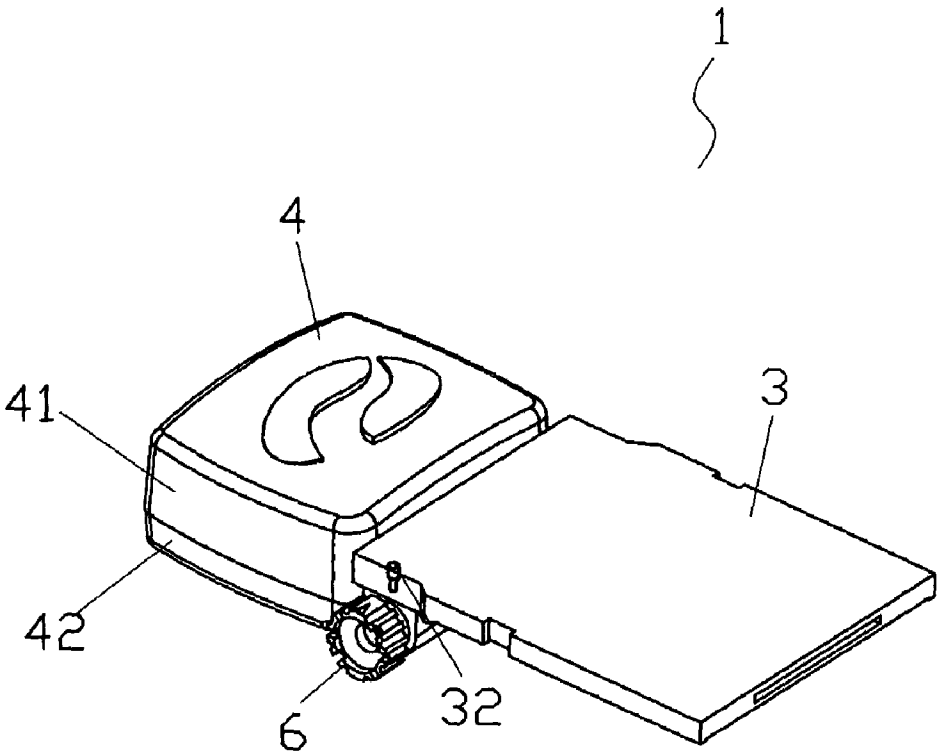
FIG. 6 shows one application of the present invention, where the present invention has connected to a satellite receiver.
Figure 7:
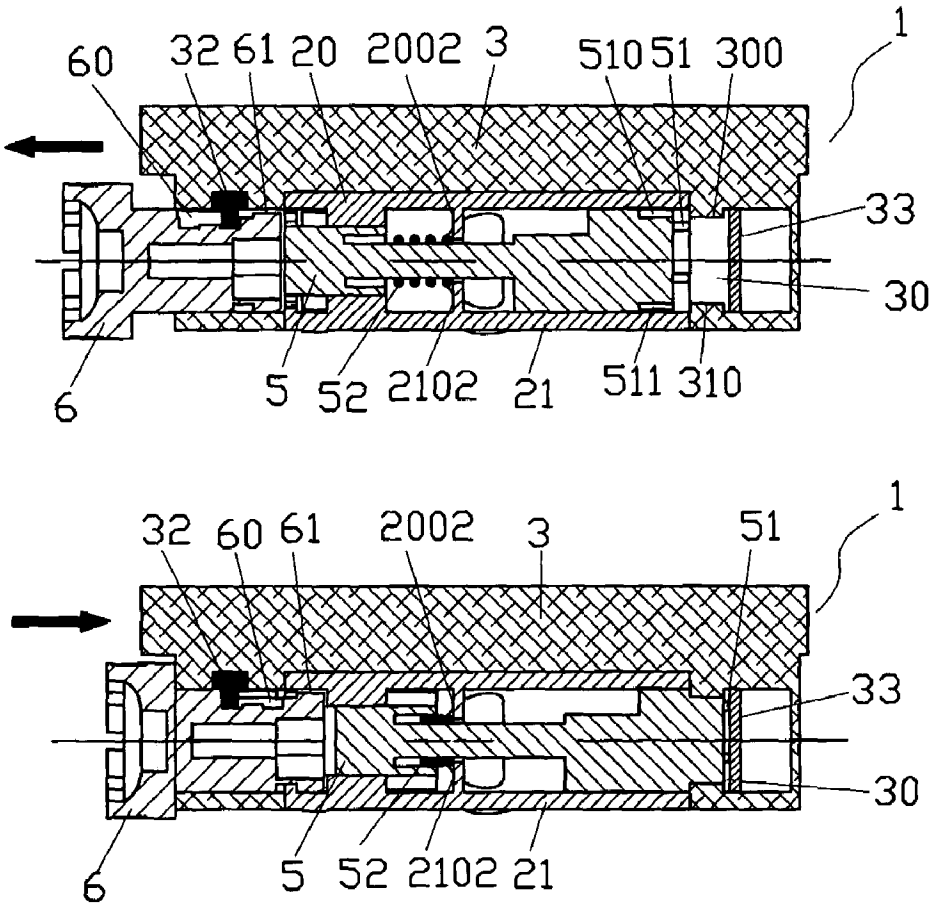
FIG. 7 shows the operation of the present invention, where a cruciform connector is used to push an actuating shaft.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 7, the present invention is illustrated. The present invention has the following elements.

A cruciform connector 6 is included. An upper side of the cruciform connector 6 has a slot 60.

A rotary joint 2 has an upper cover 20 and a lower cover 21. The upper cover 20 has two posts 200, 201 and the lower cover 21 has two holes 210, 211. The upper cover 20 has a first recess 2000, a first track 2001 and a first stop wall 2002. The lower cover 21 has a second recess 2100, a second track 2101 and a second stop wall 2102. A receiving chamber is formed by combining the upper cover 20 and the lower cover 21. An inner side of the rotary joint 2 is formed as a cruciform hollow space 22 which is capable of receiving a cruciform connector 6. A center of the rotary joint 2 is extended with a hollow post. An outer side of the hollow post is formed with two annular trenches 23, 24. Two semi-circle rings 230, 231 are embedded into the two annular trenches 23, 24. An elastic buckling ring 7 serves to enclose one of the annular trenches 23, 24 for increasing the friction force as the rotary joint 2 rotates. The other annular trench 24 serves to buckle the edges of the via holes 40 of a satellite receiver 4.

The satellite receiver 4 is formed by an upper casing 41 and a lower casing 42.

An actuating shaft 5 is installed in the receiving chamber. A head end 50 of the actuating shaft 5 has two trenches 500, 501 at two lateral sides thereof for receiving the first and second tracks. One distal end of the actuating shaft 5 opposite to the head end 50 has at least one pin 51 which is a compressible conductive metal. Two sides of the distal end of the actuating shaft 5 have respective guide grooves 510, 511. A spring 52 encloses a middle section of the actuating shaft 5. The spring 52 serves to resist against the first and second stop walls 2001, 2101 so that the actuating shaft 5 moves reciprocally.

An interface seat 3 has a first ring 30 at one end thereof and a second ring 41 at another end thereof. Two blocks 300, 301 extends from the first ring 30. The two blocks 300, 301 are capable of inserting into the two guide grooves 510, 511. The cruciform connector 6 is buckled to the second ring 31. The second ring 31 has an elastic pin 32 capable of being embedded into the slot 60 so that the cruciform connector 6 is movable in the slot 60.

The rotary joint 2 is buckled between the first ring 30 and the second ring 31 of the interface seat 3. The cruciform connector 6 passes through the second ring 31 to be embedded into the cruciform hollow space 22 to push the head end 50 of actuating shaft 5 to move towards one side. Then the cruciform connector 6 is rotated so that a cruciform rib 61 at a front end thereof moves to an inner side to the cruciform hollow space 22 to be buckled therein. Thereby the rotary shaft 2 and the interface seat 3 can be detached and assembled rapidly.

Figure 8:
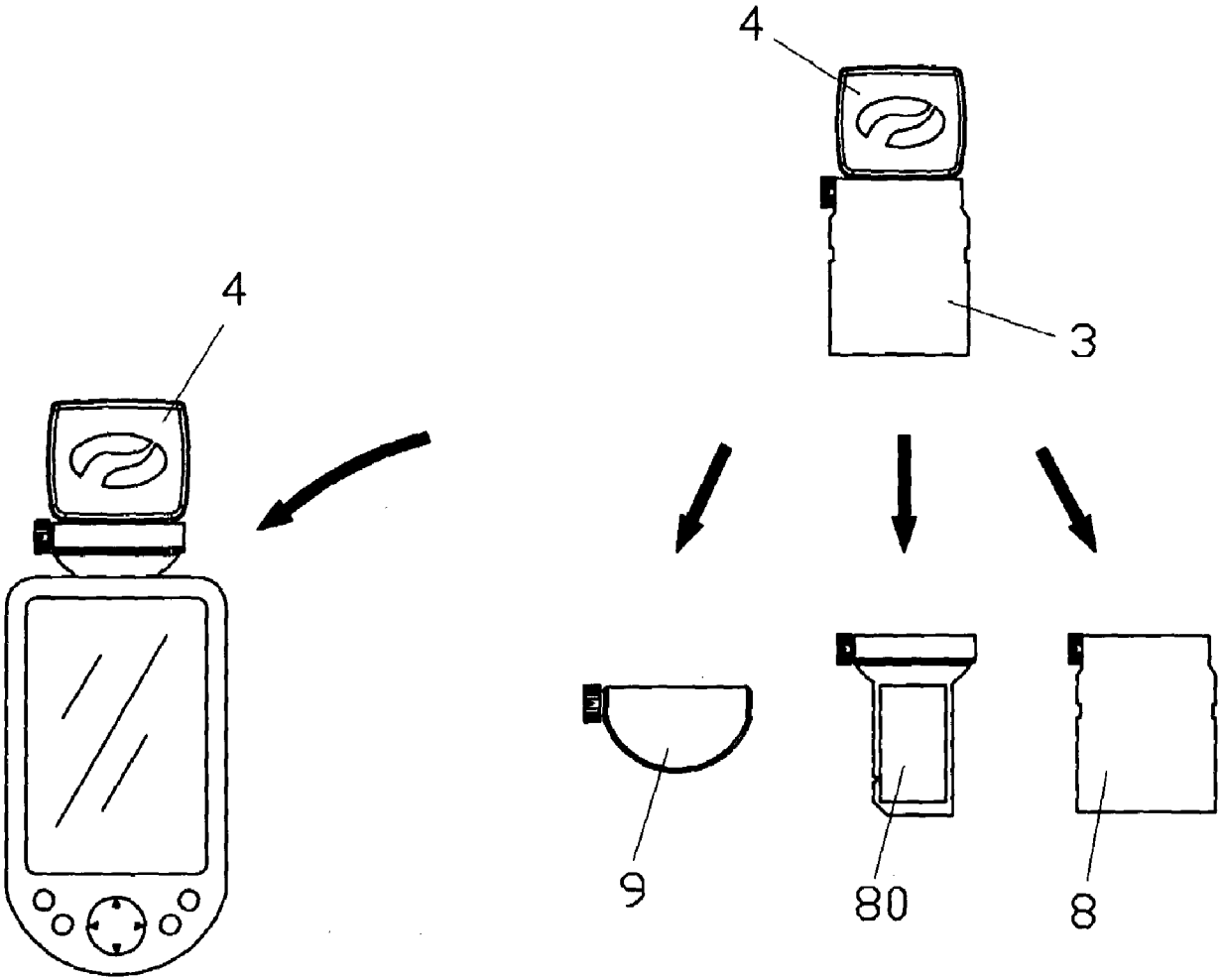
FIG. 8 shows another application of the present invention showing the update operation of the present invention.

Referring to FIG. 8, it is illustrated that the present invention can be used with various PDA interface so that the interface seat connecting to a satellite receiver 4 is updated by a different interface seats 8, 80, including, for example, compact flash (CF) cards, secure digital (SD) cards, Micro drive (MD) cards, smart media (SM) cards, memory stick (MS) cards, multi-media cards (MMC), and extreme digital (XD) cards.

Figure 9:
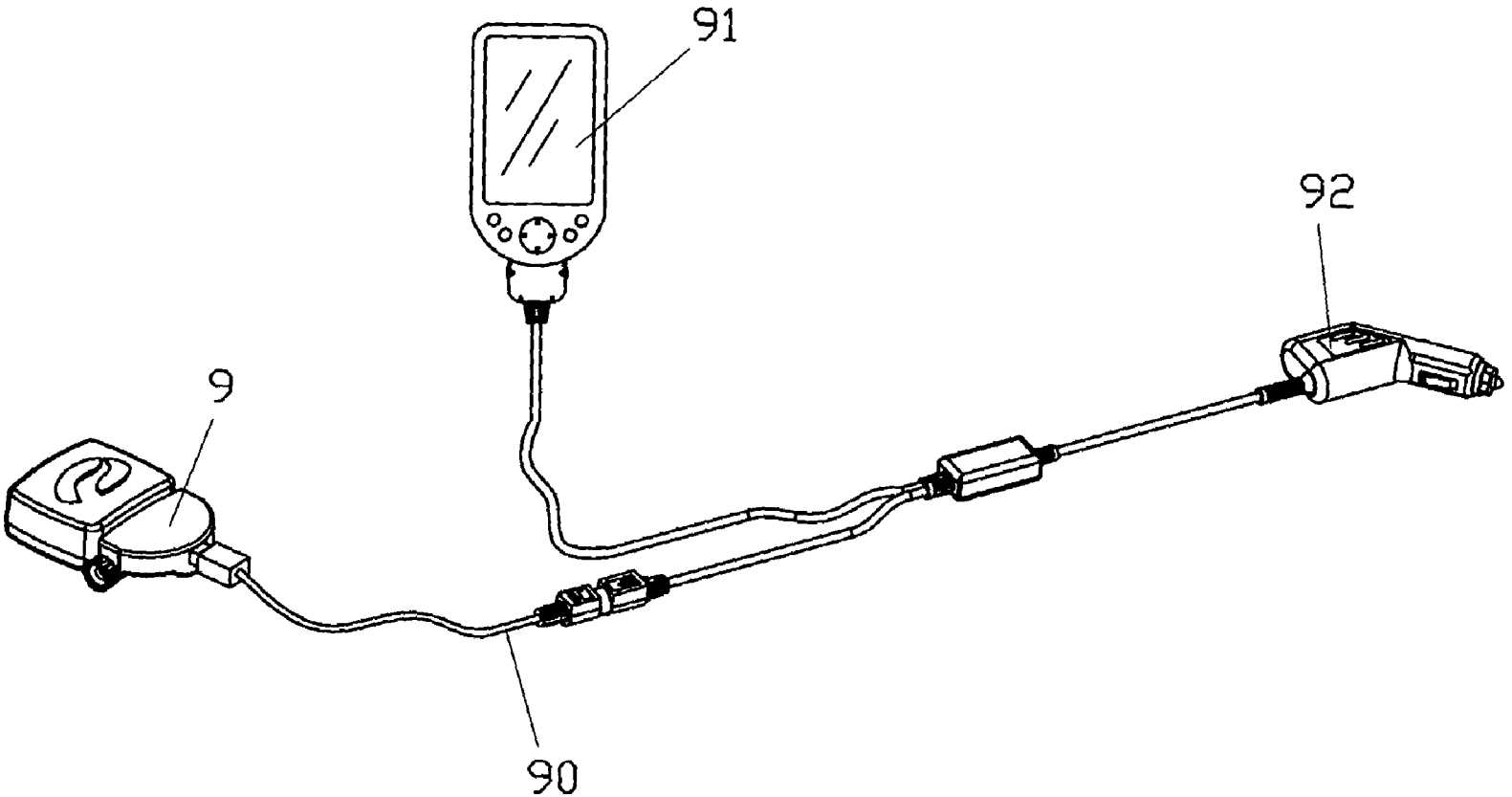
FIG. 9 shows a further application of the present invention showing the connection of the present invention, where it is connected to an RS232 interface.

Referring to FIG. 9, another embodiment of the present invention is illustrated. It is illustrated that the interface seat 3 connected to a satellite receiver 4 can be updated by an RS 232 interface seat 9. Then it is connected to a PDA 91 and a power plug 92 through a cable 90 so as to transmit signals.

Furthermore, in another application of the present invention, the satellite receiver 4 can be updated by a blue tooth receiver or a wireless broadband network receiver.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A connecting device with an adjustable rotary structure comprising:

a cruciform connector; an upper side of the cruciform connector having a slot;

a rotary joint having an upper cover and a lower cover; the upper cover having two posts and the lower cover having two holes; the upper cover having a first recess, a first track and a first stop wall; the lower cover having a second recess, a second track and a second stop wall; a receiving chamber being formed by combining the upper cover and the lower cover; an inner side of the rotary joint being formed as a cruciform hollow space which is capable of receiving the cruciform connector; a center of the rotary joint being extended with a hollow post; an outer side of the hollow post being formed with two annular trenches; a semi-circle rings being embedded into the two annular trenches; an elastic buckling ring serving to enclose one of the annular trenches; the other annular trench serving to buckle the edges of the via holes of a satellite receiver;

an actuating shaft being installed in the receiving chamber; a head end of the actuating shaft having two trenches at two lateral sides thereof for receiving the first and second tracks; one distal end of the actuating shaft opposite to the head end having at least one pin which is an compressible conductive metal; the distal end of the actuating shaft having at least one guide groove; a spring enclosing a middle section of the actuating shaft; the spring serving to resist against the first and second stop walls so that the actuating shaft moves reciprocally;

an interface seat having a first ring at one end thereof and a second ring at another end thereof; at least one blocks extending from the first ring; the two blocks being capable of inserting into the guide groove; the cruciform connector being buckled to the second ring; the second ring having an elastic pin capable of being embedded into the slot so that the cruciform connector is movable in the slot;

the rotary joint being buckled between the first ring and the second ring of the interface seat; the cruciform connector passing through the second ring to be embedded into the cruciform hollow space to push the head end of actuating shaft to move towards one side; and then the cruciform connector being rotated so that a cruciform rib at a front end thereof moves to an inner side to the cruciform hollow space to be buckled therein; thereby the rotary shaft and the interface seat can be detached and assembled rapidly.

2. The connecting device with an adjustable rotary structure as claimed in claim 1, wherein the pins of the actuating shaft is conductive metals.

3. The connecting device with an adjustable rotary structure as claimed in claim 1, wherein the interface seat is one of compact flash (CF) cards, secure digital (SD) cards, Micro drive (MD) cards, smart media (SM) cards, memory stick (MS) cards, multi-media cards (MMC), and extreme digital (XD) cards.

4. The connecting device with an adjustable rotary structure as claimed in claim 1, wherein the interface seat is an RS 232 interface seat which is connected to a personal digital assistant (PDA) through a cable.

5. The connecting device with an adjustable rotary structure as claimed in claim 1, wherein the satellite receiver is a bluetooth receiver or a wireless broadband network receiver.

* * * * *